United States Patent [19]

Goldfarb et al.

[11] 3,934,881

[45] Jan. 27, 1976

[54] MANIPULATIVE SKILL GAME APPARATUS HAVING TILTABLE PLATFORMS AND AUTOMATIC FEEDER MECHANISM

[76] Inventors: Adolph E. Goldfarb, 4614 Monarca Drive, Tarzana, Calif. 91356; Erwin Benkoe, 17965 Medley Drive, Encino, Calif. 91316

[22] Filed: Feb. 10, 1975

[21] Appl. No.: 548,398

[52] U.S. Cl. ..... 273/110; 273/120 R

[51] Int. Cl.[2] ..... A63F 7/02

[58] Field of Search..... 273/86 C, 95 R, 109, 110, 273/111, 120 R, 153 R; 46/42, 43

[56] References Cited

UNITED STATES PATENTS

| | | | |
|---|---|---|---|
| 2,772,883 | 12/1956 | Schigas | 273/110 |
| 2,975,548 | 3/1961 | Bray | 46/42 |
| 3,333,851 | 8/1967 | Rosen | 273/95 R |
| 3,570,171 | 3/1971 | Shook | 46/42 |
| 3,592,471 | 7/1971 | Swimmer et al. | 273/110 |

FOREIGN PATENTS OR APPLICATIONS

| | | | |
|---|---|---|---|
| 417,576 | 10/1934 | United Kingdom | 273/110 |
| 795,014 | 12/1935 | France | 273/110 |
| 1,025,556 | 1/1953 | France | 273/120 R |

*Primary Examiner*—Anton O. Oechsle
*Assistant Examiner*—Harry G. Strappello
*Attorney, Agent, or Firm*—Robert M. Ashen; Robert J. Schaap

[57] ABSTRACT

A manipulative skill game apparatus in the form of a generally upright game board on which are tiltably mounted (in a series extending from the top toward the bottom of the board) a plurality of tiltable, generally horizontally extending platforms. Structure is also provided for controlling the tilting of the platforms. The game includes a plurality of balls, and the platforms are in staggered positions from side to side so that a ball rolling off one end of a platform will land on an end of a platform below it. The object of the game is to tilt the platforms so as to guide a ball from a higher platform successively to lower platforms. A feeder mechanism automatically delivers the balls one at a time in timed sequence to the uppermost platform. After a predetermined timed interval the next ball is delivered to that same uppermost platform. Thus, the player must not only successfully manipulate the tilting of the platforms to guide the ball from higher to successively lower platforms, but he must also race against the clock, remove each ball as quickly as he can from platform to platform, before the next ball is delivered to the top platform. The further along the path (i.e., the lower down the platform) from where the ball is finally lost, the higher score the player gets. The feeder mechanism may be selectively pre-set to operate at one of several different rates to thereby change the difficulty of the game.

8 Claims, 8 Drawing Figures

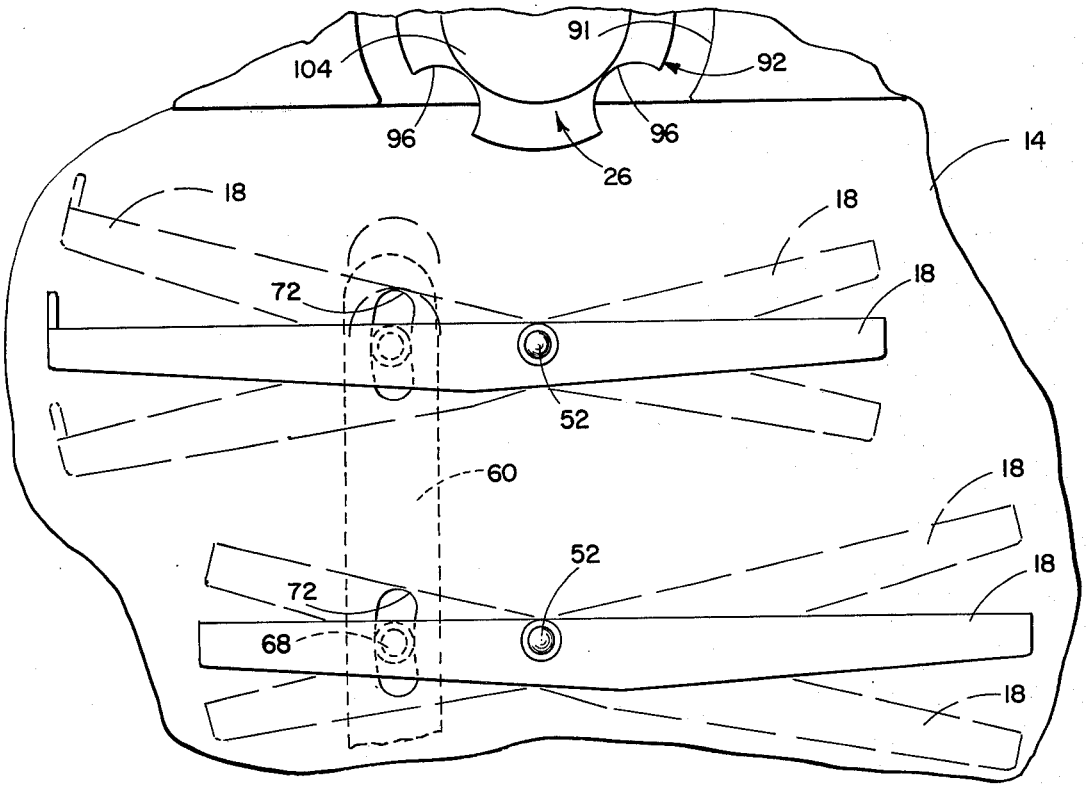
FIG. 4
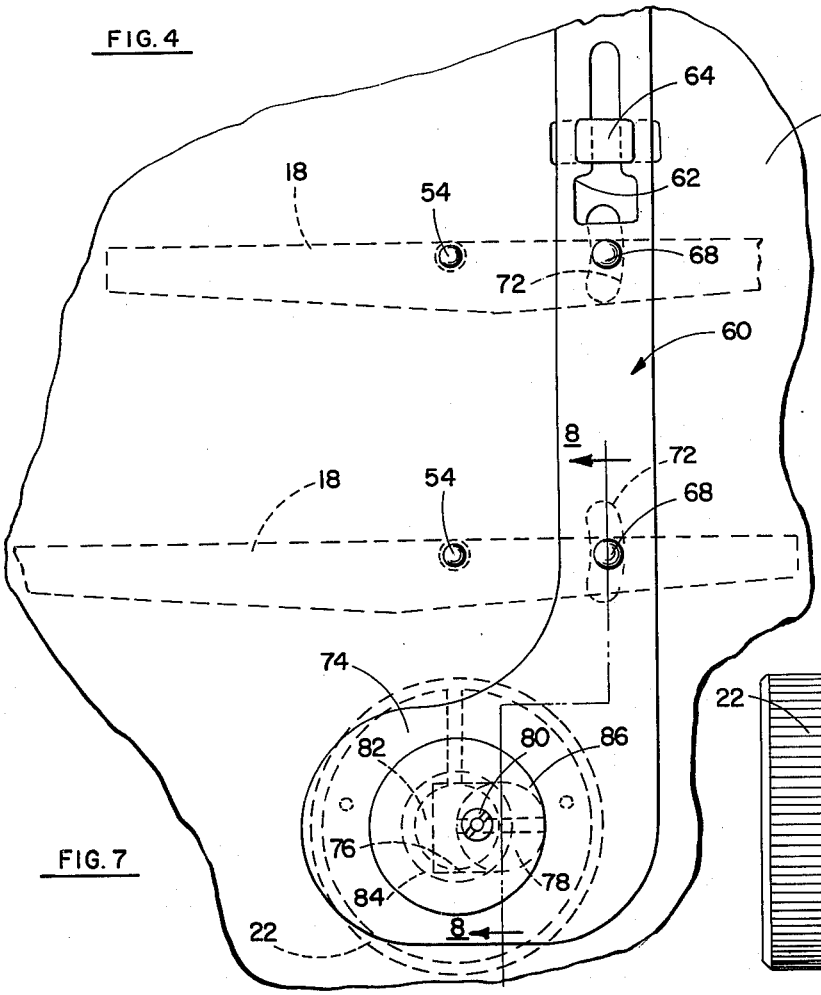
FIG. 7
FIG. 8
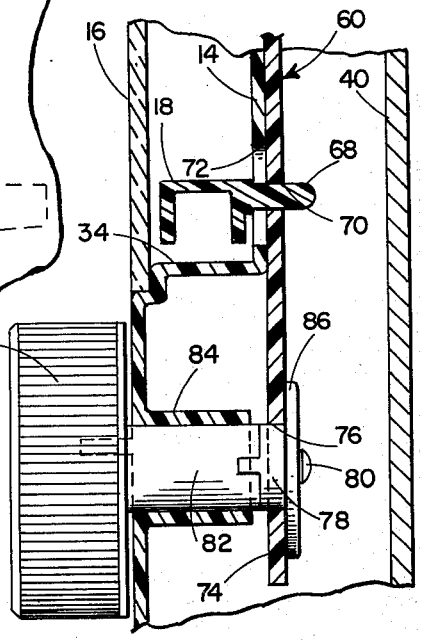

MANIPULATIVE SKILL GAME APPARATUS HAVING TILTABLE PLATFORMS AND AUTOMATIC FEEDER MECHANISM

Prior art game devices utilizing a series of tiltable platforms have been quite limited in their play value. In such prior devices, a ball would be deposited on an uppermost tiltable platform. That platform would be manipulated to roll the ball off a predetermined end onto a second platform having an end located below that end of the first platform. The second platform would then be manipulated to roll the ball off a predetermined end of that platform onto a third platform located below it. The play would proceed so long as the player was able to manipulate the platforms so as to move the ball successively from a higher platform to a lower platform. The play with that particular ball would end whenever the ball fell from the platforms without being caught by a lower platform. The player would thus test his skill in moving a ball from the highest platform successively as far as he could toward a lowermost platform. The player was left to his own devices and could take as long as he wanted to accomplish this movement of the ball. Only when he had completed play with the first ball would he then operate the device to discharge another ball onto the uppermost platform and the play of the game would continue in the same manner described above. It will be apparent that the play of this game becomes quite dull and tedious after a short time and while it helped to develop certain motor skills and coordination, it could not be expected to hold the interest of the player for very long. This was particularly so once a person had developed a reasonable amount of skill in making the ball pass from platform to platform so that the challenge was no longer provided by the game.

The present invention provides, among other features, a feeder mechanism which feeds the balls one at a time, in timed sequence, to the uppermost platform. Regardless of whether the player has completed play with one ball, when the determined time interval has passed, another ball will be deposited on the uppermost platform. If the first ball is still on one of the lower platforms, the player will be faced with trying to manipulate the platforms so as to most advantageously control the movement of two balls. After another timed interval, still a third ball will be deposited on the uppermost platform. Depending on the skill of the player and the timing of the depositing of the balls, play of this game may involve manipulating the levers to control two or more rolling balls at the same time which adds a great deal of excitement to the play of the game. Because of the time factor now introduced, the player is also motivated to try to move the ball from platform to platform in as rapid a rate as possible, commencerate with not losing the ball off the platforms completely. Further, the time interval between feeding balls may be selectively changed so that the balls will come at a more rapid rate, obviously increasing the difficulty of the game. By being able to selectively vary the rate by which the balls are fed, and thereby the difficulty of the play, a number of advantages are provided. For example, a better player may compete against a less expert player by making the time interval shorter for the better player. Further, as a player improves his skill in moving the ball downwardly from platform to platform, the rate at which the balls are fed is increased so that he is further challenged and his interest maintained for a much longer period of time. Still further, this is an excellent means for providing a game which is exciting and interesting, yet not overly difficult or frustrating for less skilled players, such as younger children. This permits them to play the game at a less demanding skill level until they have increased their own skills and capabilities, at which time the skill level can be increased. In other words, players can be brought along from lesser skill levels to higher skill levels without being unduly taxed or frustrated. Thus, the present device offers a number of advantages over those devices known in the prior art.

IN THE DRAWINGS

FIG. 4 is a frontal view taken generally along line 4—4 of FIG. 3.

FIG. 7 is an enlarged rear view of the lower tilt control portion of the game.

FIG. 8 is a sectional view taken generally along 8—8 of FIG. 7.

Figure 1:
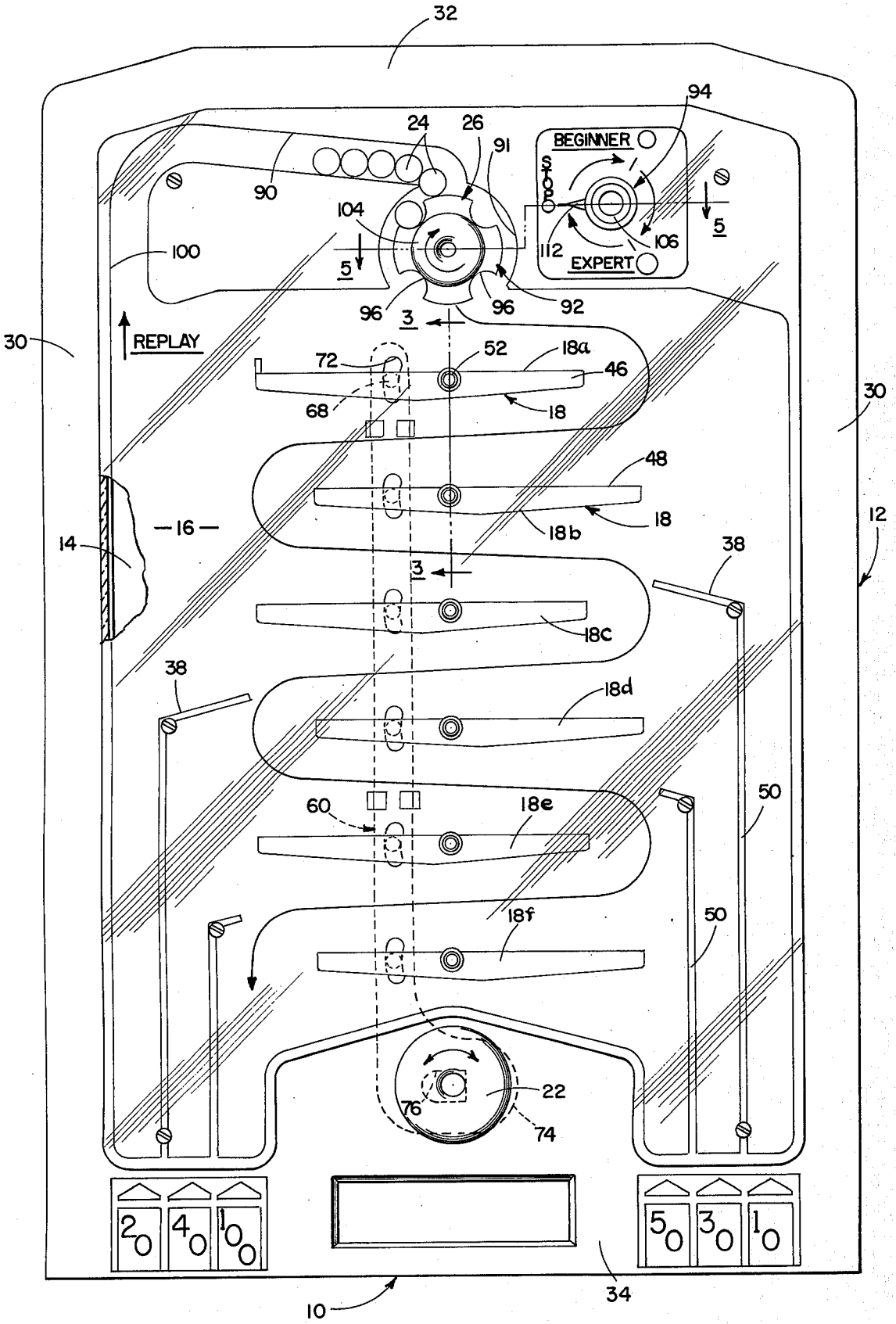
FIG. 1 is a front elevational view of a game comprising a presently preferred emmbodiment of the invention.

In general, the illustrated embodiment shown in the drawings is a game 10 which comprises a housing or enclosure 12. The housing includes a rear wall which forms a game board 14 and a transparent front wall or panel which forms a window 16. The housing is disposed so that the board 14 is generally upright. A plurality of horizontally extending platforms 18 are pivotally mounted to the front of the board 14 in a vertically extending series. Means 20 are connected to the platforms 18 and include a rotatable knob 22 which is turned by the player to effect tilting or pivoting of the platforms. The game also includes a plurality of balls 24 and discharge or feeder means 26 located at the upper end of the board 14 for delivering a ball to the uppermost platform at predetermined timed intervals. The discharge or feeder means also includes a speed control for changing the rate at which the balls are fed to the platforms.

Figure 2:
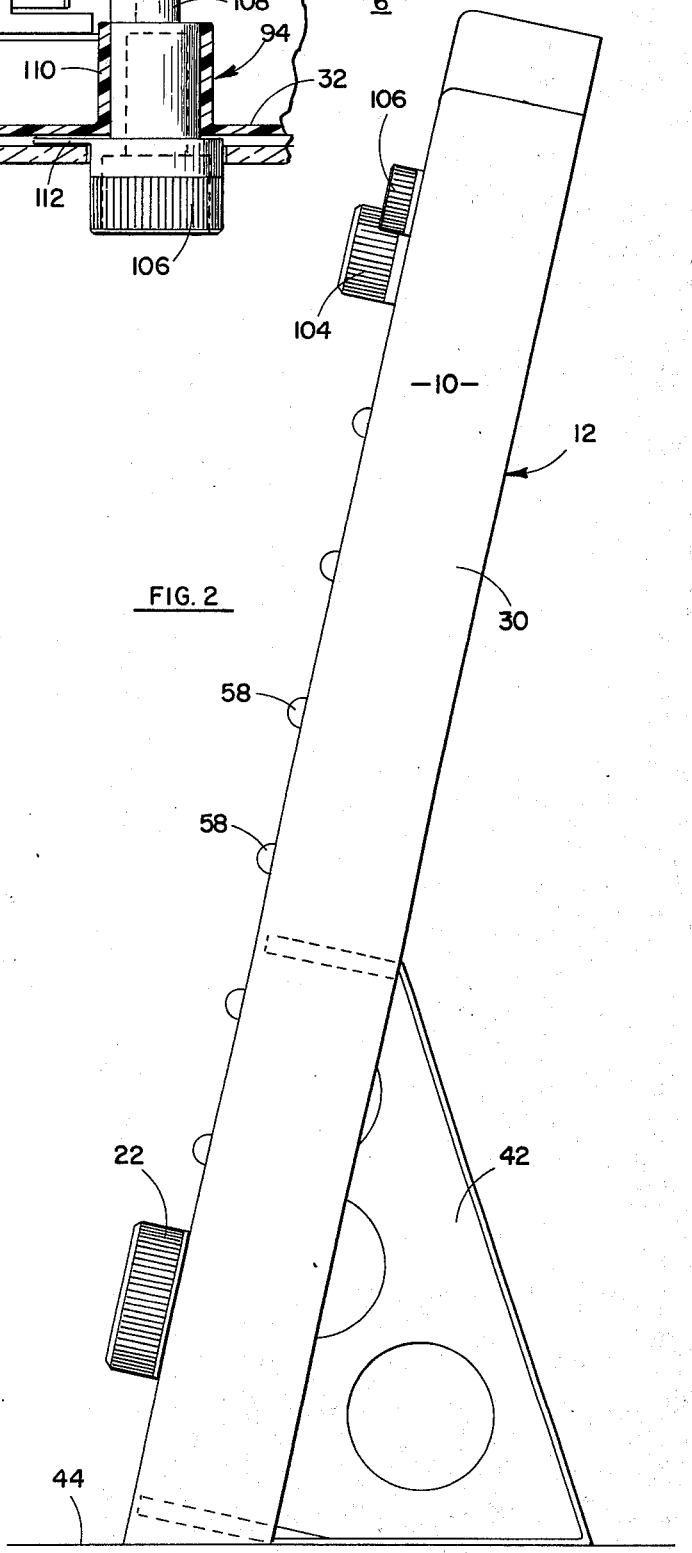
FIG. 2 is a side elevational view of the game of FIG. 1.

Now to consider the illustrated game apparatus 10 in detail. The housing 12 may be formed of a large generally rectangular molded plastic part which defines the rear board or wall 14, a pair of sidewall portions 30, a topwall portion 32, and a bottomwall portion 34. The sidewall portion and the top and bottom wall portions extend forwardly from the rearwall portion. The transparent front panel or window 16 may be mounted and positioned spaced forwardly of the board 14 and extending between side wall portions and top and bottom wall portions to define an enclosed area or compartment 36. The transparent panel 16 may be held in place by suitable means such as screws 38. The relationship of transparent panel 16 to board 14 is shown best in FIGS. 3 and 8. These figures of the drawings also illustrate a rear cover or panel 40 disposed rearwardly of the board 14. The molded plastic housing piece may include a rearwardly extending peripheral flange portion which in effect comprises continuations of the side wall portions and the top and bottom wall portions. The rear cover or panel 40 may be mounted to such peripheral flange portion by suitable means such as glue, fasteners, friction fit, etc. (not shown). FIG. 2 illustrates the housing in a generally upright, somewhat rearwardly angled position. Suitable support means such as triangular foot portions 42 may be connected to the housing. This permits the housing to stand generally upright on a supporting surface 44 such as a table or the floor.

The horizontal platforms 18 are shown best in their vertical series in FIG. 1. The platforms are shown pivoted along a common vertical line which passes through each of the horizontally extending pivot axes of the platforms. It will be noted that some of the platforms are offset to one side of this vertical center line while alternate platforms are offset to the other side of the vertical center line. In this way, each of the platforms (except the lowermost platform) has one end which terminates above an end portion of a platform immediately below it. For example, the uppermost platform 18*a* has an end 46 which terminates above the end portion 48 of the platform 18*b* which is located immediately below platform 18*a*. Because of the side-to-side staggered alternate arrangement of the platforms, when one of the balls 24 is received on an upper platform and caused to fall from the selected end of that platform, the ball will fall onto an end portion of the platform immediately below. From there, the ball may be manipulated to the opposite end of the second platform and permitted to fall from there onto the outwardly extended end portion of the next lower platform. In this way the ball may be manipulated by tilting of the platforms from the uppermost platform to the next lowest platform and onto successively lower platforms until the lowermost platform is reached. It is the object of the game to cause a ball to move from the uppermost platform to the lowermost platform.

Vertical baffle means 50 extend between the window 16 and the board 14 to define pathways to different goals, depending upon the platform from which the ball falls without landing upon the next lower platform. Thus for example, if the ball rolls from uppermost platform 18*a* to next lowest platform 18*b*, but rolls off portion 48 of platform 18*b*, the baffle 50 will direct the ball into the furthest goal to the right shown in FIG. 1. This produces a low score of 10. If, instead, the ball is manipulated to the end of platform 18*b* opposite end portion 48 it will then go to platform 18*c*. If the ball rolls off that left hand end of platform 18*c*, it will go into the goal at the far left having a point count of 20. If, instead, the ball is manipulated to the right hand end of platform 18*c*, it will fall to platform 18*d* and if it is discharged from that right hand end of platform 18*d* it will go into the goal designated 30 (second from the right). The highest score of 100 is achieved if the player is successful in manipulating the ball to the left hand end of the lowermost platform 18*f*.

Figure 3:
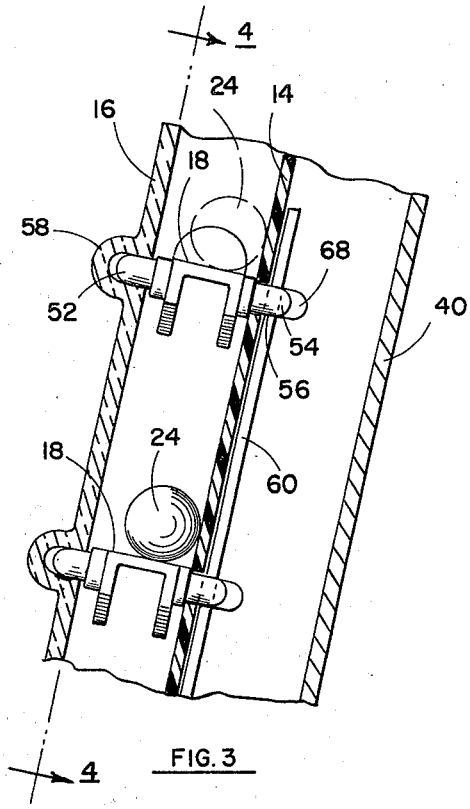
FIG. 3 is an enlarged sectional view taken generally along line 3—3 of FIG. 1.

As shown best in FIG. 3, the platforms 18 are pivotally supported between the board 14 and the transparent front panel 16. More particularly, each platform is provided at its pivot point with a forwardly extending projection 52 and a rearwardly extending projection 54. These projections 52 and 54 are generally circular in cross section to facilitate rotation of the platforms. Each rearward projection 54 is received in a mating circular hole 56 in board 14, and each forward projection 52 is received in a mating receptacle portion 58 formed in the transparent front panel 16. To assemble the illustrated apparatus, the platforms 18 may be positioned on the board 14 with the rearward projection 54 passing through the holes 56. The transparent front panel 16 may then be mounted in position with the forward projections 52 of the platforms received in the receptacle portions 58 of the front panel. This provides a simple and easy means of rotatably mounting the platforms for the desired tilting action. Further, they are firmly supported in front and back by the illustrated construction.

The tilting of the platforms 18 between various positions as illustrated in broken line in FIG. 4 is accomplished generally by upward and downward movement of a vertically extending arm 60, which is coupled to each of the platforms so that its vertical movement effects tilting movement of the platforms. More particularly, as viewed from the front of the game apparatus as seen in FIG. 1, the arm 60 is positioned to the left of the center line where the platforms are pivoted. Thus, upward movement of the arm 60 raises the left hand ends of the platforms while lowering the right hand ends; downward movement of the arm 60 lowers the left hand ends of the platforms while raising the right hand ends. The arm 60 is mounted at the rear side of the board 14 for vertical sliding movement. As shown best in FIGS. 1 and 7, the arm 60 has a pair of vertically extending cut outs 62 which are enlarged at their lower ends. The board 14 is formed at its rear with a pair of mating projections 64. Each projection 64 is proportioned to pass through the enlarged lower end of a cut out 62 but to overline the remaining upper portion of the cut out. Thus, the arm 60 may be assembled on the board 14 by aligning the enlarged lower end portions of the cut outs 62 with the projections 64 and moving the arm forwardly so that the projections pass rearwardly through those portions. The arm 60 is then moved downwardly relative to the projections 64 so that the narrow parts of the projections 64 are slidably received in the narrow upper portions of the cut outs 62, while the enlarged head portions of the projections 64 overlie the margins at either side of the narrow portions of the cutouts to retain the arm on the board.

Each platform 18 has a rearwardly extending projection 68 which extends through and is pivotably received in mating hole 70 in the arm 60. The board 14 is formed with a series of arcuate slots 72 through which the projection 68 of each platform extends. These slots 72 accommodate and also limit the pivotal movement of the platforms 18.

At its lower end, the arm 60 has a a portion 74 which extends to one side and has a cut out 76 therein. Disposed within the cut out 76 is a circular eccentrically mounted disc portion 78. The cut out 76 is enlongated from side-to-side but not from top-to-bottom relative to the disc 78, Thus, rotation of the disc 78 about its eccentric axis 80 effects vertical movement of the arm 60. The disc 78 is caused to rotate about its eccentric axis 80 by virtue of a mechanical interlock (shown in FIG. 8) between disc 78 and a shaft 82 rotatably received in a bearing section 84 of the lower housing portion 34. The shaft 82 extends through to the front of the housing where it is secured to the control knob 22. Thus, by rotating the knob 22 the shaft 82 is also rotated which causes eccentric rotation of the disc 78 and vertical, up-and-down movement of the arm 60. This in turn causes the desired tilting of the platforms 18. The shaft 82 is connected to the disc 78 as by a screw located at the axis 80, which also secures a rear retaining disc 86 to the eccentric disc 78.

The feeding means 26 is located at the upper portion of the housing above the uppermost platform 18*a*. Feeder mechanism 26 includes means defining a magazine 90 and a feeder wheel recess 91, a rotatable feeder wheel or carrier 92 in the recess 91, means 100 for rotating the carrier 92, and selection means 94 for varying the speed at which the carrier is rotated.

As shown in FIG. 1, magazine 90 is a generally horizontally extending channel which communicates through a side channel 100 with the main interior of the housing. The magazine 90 inclines downwardly slightly from the left of the board as viewed in FIG. 1 to the center of the board, where it communicates with the generally circular feeder wheel recess 91. The carrier or feeder wheel 92 is disposed centrally within this recess 91.

Figure 5:
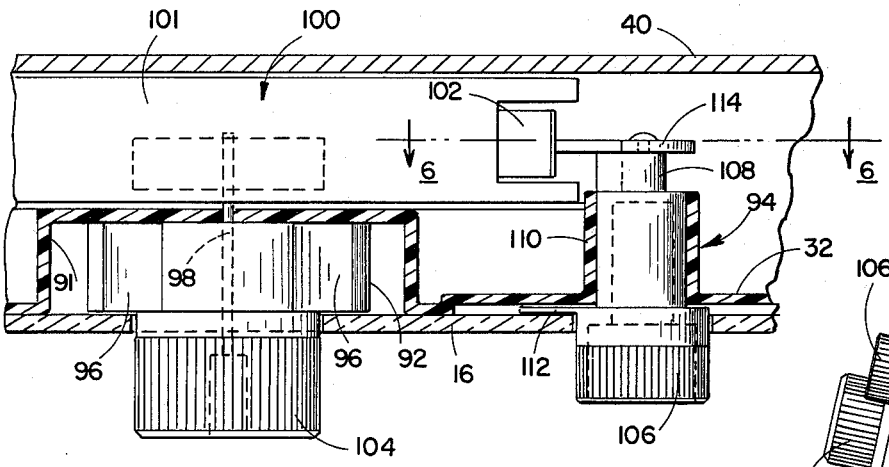
FIG. 5 is an enlarged sectional view taken generally along line 5—5 of FIG. 1.
Figure 6:
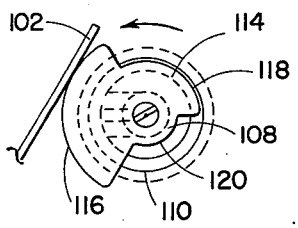
FIG. 6 is a sectional view taken generally along line 6—6 of FIG. 5.

The illustrated feeder wheel 92 is generally circular as shown in FIG. 1 and is provided with four semi-circular cutouts 96 equally spaced around the peripheral edge of the wheel. The balls 24, the feeder wheel recess 91, and the feeder wheel itself 92, are so proportioned that a ball will not fit between the outer periphery of the wheel and the wall of the feeder wheel recess; however, a ball will be received in one of the semi-circular cutouts 96 of the wheel and will then be carried by the counter-clockwise rotation of the wheel down the left hand side (as viewed in FIG. 1) of the recess 91 to where it will be deposited on the uppermost platform 18*a*. The balls flow by gravity down the inclined magazine 90 and into the upper portion of the recess 91. The balls remain there supported by the upper periphery of the rotating feeder wheel until one of the cutouts 96 aligns with the ball, and thereafter the ball is carried with the wheel as described above. As shown best in FIG. 5, the wheel 92 is mounted for rotation on a horizontally extending shaft 98 which extends through the rear wall of the feeder wheel recess 91 to a drive mechanism designated generally 100. The drive means 100 may be a conventional coil spring powered unit which is wound by rotation of the shaft 98 in a clockwise direction as shown by the arrow in FIG. 1 and which then serves to drive the shaft 98 in the opposite or counter-clockwise direction. The unit 100 may include a conventional escapement mechanism which serves to control the speed at which the spring drives the shaft 98 and thus the wheel 92. The escapement mechanism may include an oscillating finger 102 which is exposed at one end of the housing 101 of the drive means 100. A winding knob 104 may be secured to the outer end of the shaft 98 and extend through a mating opening in the window panel 16 for manually rotating the shaft 98 to wind the spring of the power unit. Thus, the wheel 92 rotates continuously, to automatically deliver the balls at equal time intervals.

The selection means 94 for varying the speed at which the carrier wheel 92 is rotated includes a knob 106 secured to a shaft 108 which is rotatably journaled in a tubular section 110 of the housing top wall portion 32. The setting knob 106 is provided with a pointer section 112 and markings are provided on the front face of the housing upper section 32 to indicate "Beginner", "Expert", and "Stop" positions for the pointer 112. It will be noted that the knob 106 extends through a mating opening in the window panel 16 so that the knob may be rotated from outside of the compartment.

A cam segment 114 is secured to the rear end of the selector shaft 108 in juxtaposition to the oscillating finger 102 of the escapement mechanism. When the knob 106 is rotated to point the pointer 112 at the Stop position, the radially largest segment 116 of the cam 114 is disposed adjacent the finger 102, and this serves to restrict movement of the finger 102 so as to stop rotation of the feeder wheel 92. When the selector knob 106 is rotated to point at the Expert position, the radially intermediate section 118 of the cam segment 114 is positioned adjacent the finger 102 which permits a relatively short oscillating stroke of the finger and produces a relatively fast rotation of the feeder wheel 92. When the selector knob 106 is rotated to the Beginner position, the radially smallest portion 120 of the cam segment 114 is located adjacent the arm 102 which permits a longer oscillating stroke of the arm 102 whereby the escapement mechanism operates in a conventional manner to produce a relatively slow rotation of the feeder wheel 92. Thus, by positioning of the selector knob 106, the action of the feeder wheel 92 in delivering balls to the platforms may be stopped, operated at a slow or beginner rate, or operated at a faster or expert rate. As discussed above, the faster the successive balls are delivered to the uppermost platform, the faster the player must manipulate the platforms to try to move a ball along the platforms before the next ball is delivered, and thus the more difficult the play of the game.

Various modifications and changes may be made in a specific illustrated structure without departing from the spirit and scope of the present invention as is defined in the appended claims.

What is claimed is:

1. Manipulative skill game apparatus comprising a. a generally upright board having a front face, b. a means on said board defining series of generally horizontally disposed platforms arranged generally below one another at said board front face, each of said platforms being tiltable about a generally horizontal axis extending forwardly from the front face of said board, c. means attached to said board defining an enclosure around the said platforms and being at least partially transparent, d. a plurality of balls within said enclosure e. control means coupled to said platforms, and accessible from outside of said enclosure for tilting said platforms to effect movement of balls from a successively higher platform to a lower platform, f. discharge means located in said enclosure above said platforms for automatically delivering the balls to the platforms at timed intervals, so that there will be more than one ball on the platforms unless the player completes the play sequence of each ball within its time interval.

2. The game apparatus of claim 1 wherein said discharge means may be selectively preset for at least two different delivery rates at which the balls will be delivered to the platforms.

3. The game apparatus of claim 1 wherein said discharge means comprises a rotatable member, housing means around said rotatable member defining an inlet and an outlet, means on said rotatable member for moving a ball from the inlet to the outlet, and means for controlling the rotation of said member to determine the rate of delivery of the balls to the platforms.

4. The game apparatus of claim 3 wherein said rotatable member rotates continuously at a fixed speed.

5. The game apparatus of claim 4 wherein said control means is operable to selectively change the speed of rotation between different values.

6. The game apparatus of claim 1 wherein means are provided in said enclosure at a lower portion of board below the platforms defining receptacles for the balls, the receptacles being arranged to receive balls from different of said platforms.

7. The game apparatus of claim 3 wherein the inlet to said rotatable member is above said member, and apparatus further including means in said enclosure defining a path from the area of the enclosure below the platforms to said inlet.

8. The game apparatus of claim 7 wherein said path defining means also define a magazine for holding a plurality of the balls for delivery one at a time to the inlet, said magazine having a downwardly inclined ramp.

* * * * *